United States Patent [19]

Case

[11] Patent Number: 4,549,613

[45] Date of Patent: Oct. 29, 1985

[54] DOWNHOLE TOOL WITH REPLACEABLE TOOL SLEEVE SECTIONS

[76] Inventor: Wayne A. Case, 2005 SW. 71st St., Portland, Oreg. 97225

[21] Appl. No.: 515,987

[22] Filed: Jul. 25, 1983

Related U.S. Application Data

[63] Continuation-in-part of Ser. No. 403,483, Jul. 30, 1982, abandoned.

[51] Int. Cl.[4] ..... F21B 17/10

[52] U.S. Cl. ..... 175/325; 175/406; 166/241

[58] Field of Search ..... 175/325, 406; 166/241; 308/4 A; 384/295, 281

[56] References Cited

U.S. PATENT DOCUMENTS

| | | | |
|---|---|---|---|
| 1,754,830 | 4/1930 | MacClatchie | 175/406 X |
| 1,764,133 | 6/1930 | Weisgerber | 175/406 X |
| 1,764,377 | 6/1930 | Wickersham | 175/406 X |
| 2,210,824 | 8/1940 | Walker, Sr. | 175/406 X |
| 2,719,699 | 10/1955 | Baker | 175/406 X |
| 3,276,824 | 9/1966 | Carter | 308/4 A |
| 3,447,839 | 6/1969 | Salvatori | 308/4 A |
| 3,933,395 | 1/1976 | Evans | 308/4 A |
| 4,108,257 | 8/1978 | Sizer | 175/325 |
| 4,245,709 | 1/1981 | Manuel | 308/4 A |
| 4,258,804 | 3/1981 | Richey et al. | 308/4 A |

FOREIGN PATENT DOCUMENTS

| | | | |
|---|---|---|---|
| 1016660 | 3/1957 | Fed. Rep. of Germany | 175/406 |
| 2518150 | 4/1976 | Fed. Rep. of Germany | 384/295 |

*Primary Examiner*—Stephen J. Novosad
*Assistant Examiner*—Thuy M. Bui
*Attorney, Agent, or Firm*—Hubbard, Thurman, Turner & Tucker

[57] ABSTRACT

A downhole tool for insertion in a drill stem includes elongated cylindrical half sleeve tool sections adapted to be non-rotatably supported on an elongated cylindrical body. The tool sections are mountable on and removable from the body without disconnecting either end of the tool from a drill stem. The half sleeve tool sections are provided with tapered axially extending flanges on their opposite ends which fit in corresponding tapered recesses formed on the tool body and the tool sections are retained on the body by a locknut threadedly engaged with the body and engageable with an axially movable retaining collar. The tool sections may be drivably engaged with axial keys formed on the body or the tool sections may be formed with flat surfaces on the sleeve inner sides cooperable with complementary flat surfaces formed on a reduced diameter portion of the body around which the tool sections are mounted.

38 Claims, 10 Drawing Figures

DOWNHOLE TOOL WITH REPLACEABLE TOOL SLEEVE SECTIONS

CROSS-REFERENCE TO RELATED APPLICATION

This application is a continuation-in-part of application Ser. No. 403,483, filed: July 30, 1982 now abandoned.

BACKGROUND OF THE INVENTION

1. Field of the Invention

The present invention pertains to a downhole tool for insertion in a drill stem for earth drilling and having interchangeable cylindrical half sleeve tool sections which are supported on a body. The interchangeable tool sleeve sections may comprise drill stem stabilizers, reamers or hole enlarging tools, for example.

2. Background

In oil, and gas well and other types of earth drilling operations it is often necessary to provide downhole tools interposed at predetermined points in the drill stem, also commonly called the drill string, for performing functions such as stabilizing or centralizing the drill stem in the hole, reaming the hole or other structures in the hole and performing various other operations such as undercutting or enlarging the hole diameter at a predetermined depth. Downhole tools such as stabilizers, reamers and the like are subject to high rates of wear and require frequent replacement or repair. Typically, these tools are formed on a body or sub having conventional pin and box threaded ends and adapted to be interposed in the drill stem between any two of the end-to-end coupled drill pipe sections, or connected to the lower end of the drill stem. The replacement of worn or damaged tools of the aforementioned type can be expensive and time consuming if it is required to break one or both of the joints between the tool body and the drill stem in order to replace the tool itself. Moreover, with each drill stem joint makeup or breakout operation there are the ever present dangers associated with handling the pipe section above the joint and creating the possibility wherein the drill stem portion remaining in the hole may fall out of the slips or other supports on the drill rig floor and back into the drillhole. Accordingly, it is highly desirable to be able to replace downhole tools such as stabilizers, reamers and the like without decoupling the tool itself from the drill stem.

Another problem associated with replacing drill stem stabilizers, reamers and other downhole tools pertains to the condition that, with integral tool structures, the entire tool including the sub or body must be replaced or repaired if the tool wear surfaces become excessively worn or damaged. This is expensive and wasteful of a considerable portion of the tool structure and adds to the cost of drilling operations. Therefore it has been considered highly desirable to provide downhole tools which have replaceable tool inserts or sections wherein the tool components which are subject to wear or are likely to be damaged can be replaced without replacing the entire tool body.

In an effort to overcome the aforementioned problems downhole tools have been developed wherein the tool body is adapted to support a replaceable tubular sleeve having stabilizer wear surfaces or reamer cutting surfaces thereon. However, this type of replaceable downhole tool requires disconnecting at least one joint between the tool and the drill stem to replace the sleeve.

Other types of downhole tools have been developed wherein tool sections or inserts are secured to the tool body by threaded fasteners and other support parts which are separate from the tool body. This design approach is undesirable because of the risk of failure or loosening of the fasteners under the severe loading which downhole tools are subjected to while in the hole, or due to the possible loss of the fasteners and other support parts during tool replacement or servicing operations. This latter aspect of prior art replaceable downhole tools is particularly disadvantageous when working with such tools on the rig floor wherein there is considerable likelihood of loss of the fasteners or other relatively small parts down the drillhole. Such mishaps require expensive and time consuming fishing operations or can result in damage to the drill stem or bit by the presence of these objects in the drillhole when drilling operations are resumed. Moreover, replacement and servicing operations for these last mentioned type of tools are time consuming and usually require the use of special tools and procedures.

Accordingly, the problems related to the use of prior art downhole tools been somewhat vexatious to the art worker and there has been a continuing need to improve the types of downhole tools discussed herein. To this end the present invention provides several embodiments of an improved downhole tool having replaceable tool sections which can be interchanged quickly without disconnecting or removing the tool body from the drill stem and without the use of relatively small, weak and easily lost or damaged parts.

SUMMARY OF THE INVENTION

The present invention pertains to an improved downhole tool for use in with a drill stem and including a body which may be interposed in the drill stem for supporting replaceable tool sleeve sections which may be rapidly and easily interchanged with other sleeve sections without disconnecting the body from the drill stem.

In accordance with one aspect of the present invention there is provided a downhole tool having a cylindrical body provided with opposed threaded portions for interconnection in an elongated drill stem and adapted to support a pair of opposed generally cylindrical half sleeve tool sections which are mounted on the body and may be released from the body for repair or replacement by moving the tool sections radially with respect to the longitudinal axis of the body and without removing any other component parts from the tool itself. In particular, the present invention provides a tool having replaceable tool sleeve sections which are releasably retained on a tool body by a nut which is movable axially on the tool body and is retained substantially permanently on the body. The nut is preferably formed by an internally threaded cylindrical collar which may be tightened or loosened by tools normally used in connection with drill stem joint makeup or breakout operations on the drill rig.

In accordance with another aspect of the present invention there is provided a downhole tool having a plurality of replaceable tool sections which may be installed on a cylindrical body and retained on the body by an improved mechanism including a cooperating collar and locknut which are retained permanently on the tool body and are not susceptible to being inadvertently lost or dropped down the drillhole. The locknut configuration may include a collar which is axially slidable on the tool body but not rotatable and which is engaged with the locknut and with the replaceable tool sections to lock the tool sections in position on the body. The collar may also be threadedly engaged with the body whereby a double locknut arrangement is provided. The locknut is desirably threaded in a direction which will result in tightening of the locknut during normal drill stem rotation to minimize accidental disassembly or loosening of the locknut. The combination of the locknut and the particular configuration of the tool sleeve sections provides for rapid replacement of the tool sections without handling small loose parts, and without the use of special tools.

In accordance with still another aspect of the present invention there is provided a downhole tool having a body insertable in a drill stem and adapted to receive a selected one of a plurality of different tool sections including cylindrical half sleeve stabilizer sections, reamer tools and hole opener tools, for example. Each of the half sleeve tool sections are provided with locking surfaces which engage cooperating surfaces on the body to lock the sleeve sections against rotation with respect to the body. The cooperating locking surfaces may be provided by axially projecting abutments on the body engageable with portions of opposed flanges on the sleeve sections, or the body and the sleeve sections may be provided with relatively large cooperating bearing surfaces which have high load bearing capability, are not exposed to the exterior of the tool and are thereby prevented from incurring damage or undo wear during operation of the tool.

In accordance with yet further aspects of the present invention the replaceable tool sleeve sections are preferably provided with tapered peripheral flanges on opposed ends of the sleeve sections which cooperate with tapered recesses in the body and on the locknut or an intermediate locking collar to substantially center the tool sections coaxially with respect to the axis of rotation of the tool body. An important feature of the invention resides in the provision of a one-piece tool body which is of substantial strength and does not compromise the strength of the drill stem. Another feature of the invention resides in the provision of replaceable tool sections and cooperating surfaces on the tool body which are spaced apart dimensionally in such a way that the tool sections cannot be installed improperly, are conveniently retained on the body during installation and removal and are unlikely to be lost or fall of the body.

Those skilled in the art will recognize the abovedescribed features and advantages as well as additional superior aspects of the invention upon reading the detailed description which follows in conjunction with the drawing.

DESCRIPTION OF THE PREFERRED EMBODIMENTS

Figure 1:
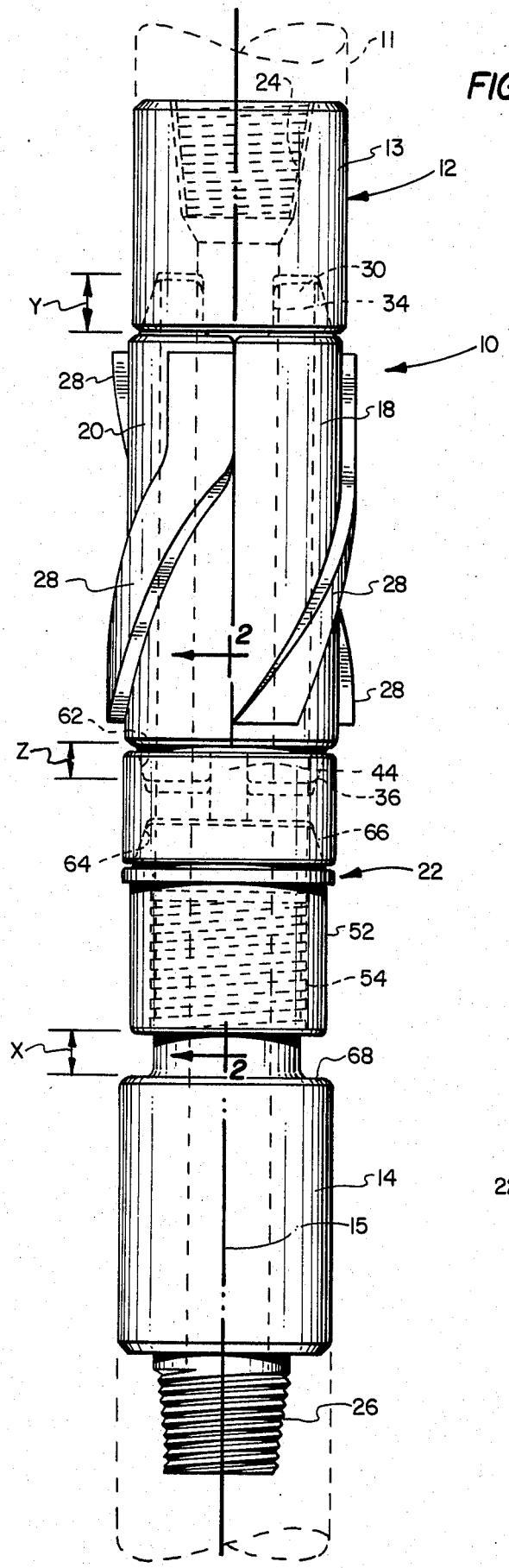
FIG. 1 is a side elevation of one embodiment of a downhole tool in accordance with the present invention.

In the description which follows like parts and specific features of parts are marked throughout the specification and drawing with the same reference numerals, respectively. The terms upper and lower as used herein are for reference purposes only as regards a preferred orientation.

Figure 2:
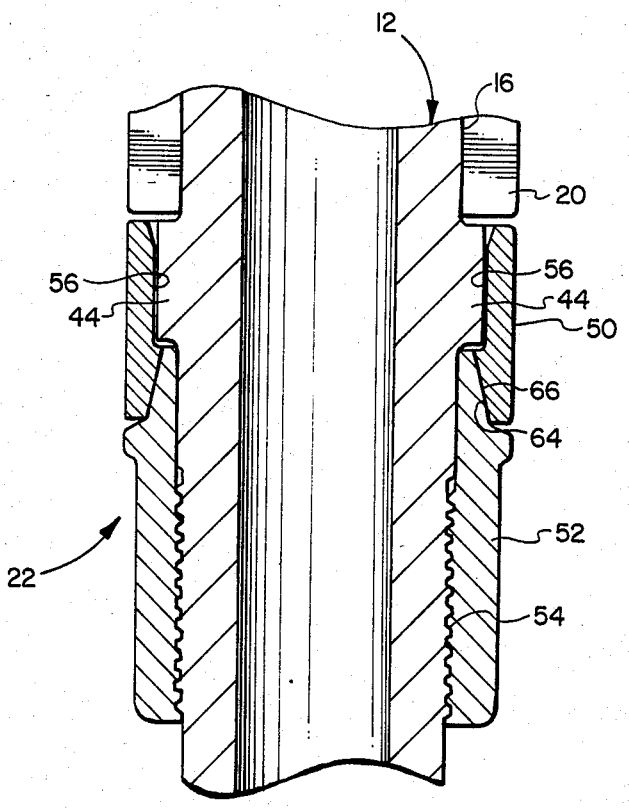
FIG. 2 is a detail longitudinal central section view taken along the line 2—2 of FIG. 1.
Figure 3:
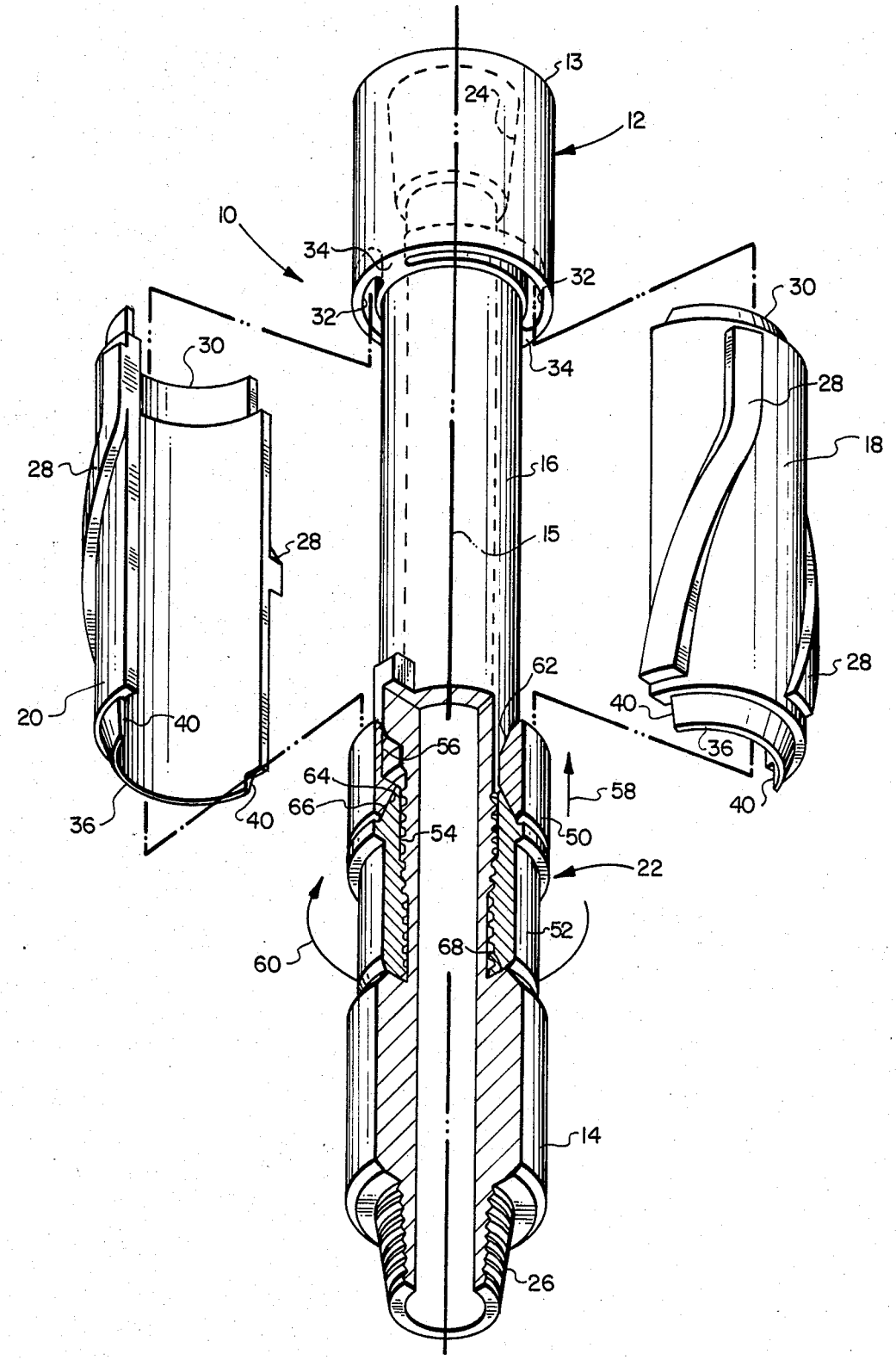
FIG. 3 is a perspective view, partially sectioned and partially exploded, of the tool embodiment illustrated in FIGS. 1 and 2.

Referring to FIGS. 1, 2 and 3, there is illustrated an improved downhole tool, generally designated by the numeral 10, which is adapted to be interposed in a drill stem 11. The tool 10 is characterized in the embodiment of FIGS. 1 through 3 as a stabilizer for use in guiding or centralizing an elongated drill stem made up of drill pipe or rod sections connected end-to-end in a conventional manner. The tool 10 is interposed in the drill stem 11 in a selected position and one or more such tools may be utilized in the drill stem depending on its overall length and other conditions in the drillhole.

The tool 10 includes an elongated, hollow, cylindrical body 12 having an enlarged head portion 13, an enlarged tail portion 14, and an intermediate or central portion 16 of reduced diameter. The tool 10 includes an elongated cylindrical stabilizer wear sleeve which is split longitudinally into at least two partial cylindrical sleeve tool sections 18 and 20, adapted for releasable mounting to the body portion 16. The tool 10 is also provided with an improved mechanism 22 for securing the tool sections 18, 20 on the body 12 will be as explained herein.

The body 12 is adapted for connection as one section of drill stem 11 intermediate the ends of the drill stem or at its lower end, if desired. The head 13 is provided with an internally threaded receptacle or box portion 24 for receiving a corresponding externally threaded pin portion of a standard drill pipe or drill collar. An externally threaded pin portion 26 extends from the tail portion 14 for connection to a continuing downhole section of the drill stem 11, or to a nose cap, not shown.

The tool sections 18 and 20, when mounted on the body 12, form a generally cylindrical sleeve and the tool sections 18, 20 have inner sides with curved surfaces having a radius approximately the same as the radius of the body portion 16. In addition, each of the tool sections 18, 20 surround approximately 180° of the body portion 16. Because of this relatively large bearing surface are provided by and between the tool sections 18, 20 and the body portion 16 and the size of the tool sections, they tend to remain on the body 12. Thus, even in the unlikely event that the mechanism 22 should accidently be loosened, the tool sections 18, 20 tend to stay in place on the body 12. Of course, the partial sleeve sections 18, 20 may comprise more than two parts, and the parts forming the tool sections are not required to entirely encircle the body 12.

The exemplary tool sections 18, 20 are provided with tool means comprising wear flutes, or ribs 28 which bear against the wall of a drillhole, not shown, to thereby guide or center the drill stem. The ribs 28 can be helically curved, as shown, or of other designs. Moreover, stabilizer tool sections of various designs, outer diameters and other dimensions, with a common inner dimension and configuration, can be mounted to the body 12. As will be described further herein, tool sections for performing other functions may be used in place of the stabilizer type tool sections 18, 20. Therefore, merely by interchanging the tool sections 18, 20, the tool 10 is suitable for a variety of applications and drillhole sizes and conditions. For example, as a drillhole for a well is bored deeper, its diameter is typically reduced to facilitate drilling operations. With the present invention, the stabilizer tool sections 18, 20 can be readily changed as the diameter of the hole is changed.

The tool sections 18, 20 each include means for mounting and retaining the tool sections on the body 12 including upper longitudinally tapered arcuate retaining flanges 30 which are insertable within corresponding arcuate tapered recesses 32 formed in the head 13. Web portions 34 are formed in the head 13 between the recesses 32 providing abutments which engage the sides of the flanges 30 to prevent rotation of the upper ends of tool sections 18, 20 about the longitudinal central axis 15 of body 12. The tool sections 18, 20 are also provided with tapered arcuate retaining flanges 36 at their respective opposite ends, as shown. The flanges 36 are each formed to provide notches 40 which are dimensioned to receive abutments or keys 44, projecting outwardly from the body portion 16. The keys 44 prevent the lower ends of the tool sections 18, 20 from rotating relative to the body 12. In addition, the keys 44 limit axial sliding movement of the tool sections 18, 20 after they are mounted on the body 12.

The mechanism 22 for securing the tool sections 18, 20 on the body 12 includes an annular collar 50 and an internally threaded locknut 52 mounted on a threaded lower part 54 of the intermediate or central body portion 16. The locknut 52 continuously engages the threaded part 54 and the locknut is thus axially movable on the body 12 and is also permanently retained on the body between the tail portion 14 and the head portion 13. The collar 50 is adapted to hold the tool sections 18, 20 in position on the body 12 when the locknut 52 is tightened against the collar. The collar 50 is also provided with respective slots 56 (one being shown in FIG. 3) which receive the keys 44. At all times, a portion of a key 44 is positioned within the slot 56 to prevent the collar 50 from rotating relative to the body 12; however, the collar 50 is allowed to slide axially into engagement with the tool sections 18, 20 in the direction of arrow 58, as the locknut 52 is tightened by rotating it in the direction shown by arrow 60. Also, the collar 50 is free to slide axially in the opposite direction to release the tool sections 18, 20 for removal radially from the body 12 when the locknut is sufficiently loosened. Because the collar 50 is restrained against free rotation, it tends to hold the locknut 52 against undesired loosening.

Referring to FIG. 1, in particular, the upper end of collar 50 is formed with a recess defined by an annular wedging surface or lip 62 which engages the lower tapered retaining flanges 36. Also, the lower end of the collar 50 is similarly formed to provide an annular lip or wedging surface 64, and the upper end of the locknut 52 is tapered to provide a cooperating wedging surface 66. As the locknut 52 is tightened, for example, by using power tongs or other wrench means used for drill stem connections, not shown, the upper retaining flanges 30 are driven tightly into the recesses 32. In addition, wedging surface 62 of collar 50 is wedged against the lower retaining flanges 36, and the locknut wedging surface 66 is wedged against the collar wedging surface 64. Thus, the tool sections 18, 20 are securely held on the body 12. In addition, the cooperating wedging surfaces advantageously center the tool sections 18, 20 coaxially on the body 12 so that the ribs 28 wear evenly when engaging the borewall of the drillhole. This feature increases the life of the stabilizer tool sections.

The downhole tool 10 is constructed to minimize the risk of the tool sections 18, 20 falling off the body 12 and down the drillhole thereby becoming lost and where they can damage the drill pipe and drill bit or other equipment in the hole. The arrangement of the cooperating wedging surfaces on the flanges 30 and 36 and defining the recesses in the head 13 and on the collar 50 aids in retaining the tool sections 18, 20 on the body 12. Also, the actual physical size of the half sleeve tool sections 18, 20 reduces the chance that the tool sections will fall free of the body 12 or into the slips on the drill rig, or down the drillhole. In addition, the relative axial lengths of the upper retaining flanges 30, the lower retaining flanges 36, and the maximum distance of travel of the locknut 52, are designed to prevent the tool sections from falling off the body 12. Specifically, as shown in FIG. 1, an annular shoulder 68 of body tail portion 14 limits the maximum travel of the locknut 52 to a distance X. In addition, the effective axial length of the upper retaining flanges 30 is Y, which is greater than X, and the effective axial length of the lower retaining flanges 36 is Z, which is less than X.

With these relative dimensions, the tool sections 18, 20 are installed and removed as follows. The tool sections 18, 20 are moved generally radially toward the body 12 and with slight axial movement the upper retaining flanges 30 are inserted within recesses 32, and the tool sections 18, 20 are urged upwardly. With the locknut 52 backed off to its fullest extent, the lower retaining flanges 36 clear the upper end of the collar 50 as the tool sections 18, 20 are moved somewhat radially toward each other to surround the body portion 16. Then the tool sections 18, 20 can be lowered slightly and be positioned in the recess formed by the surface 62 of the collar 50 and against the body section 16. Because the upper flanges 30 are simultaneously held in recesses 32, a workman can remove his hands from the tool sections 18, 20 after positioning them on the body 12 and prior to tightening the locknut 52. This advantageously reduces the risk of pinching or other injury to the workman's hands. The locknut 52 is then tightened to secure the tool sections 18, 20 to the body 12.

When the locknut 52 is loosened to remove the tool sections 18, 20, these sections may travel downwardly with the downward movement of the collar 50. However, because the upper flanges 30 are of a length greater than the maximum distance of travel of the locknut 52, they are retained within the recesses 32.

This virtually eliminates the risk of the tool sections 18, 20 falling free onto the rig floor or into the drillhole. The tool sections 18, 20 are removed by pushing them upwardly until the lower flanges 36 clear the upper end of the collar 50. The lower ends of the tool sections 18, 20 are then spread radially outward so that the tool sections can be pulled downwardly a short distance and moved free of the body 12. The corners of the upper flanges 30 are preferably rounded so they do not bind against the boundary surfaces of the recesses 32 during installation and removal of the tool sections.

As is readily apparent from the foregoing description, the downhole tool 10 characterized as a drill stem stabilizer is provided with tool sections which can be rapidly removed and installed without disconnecting the drill stem at the tool itself. Moreover, the tool sections retaining and securing mechanism comprising the collar 50 and locknut 52 remains on the tool body 12, and the locknut is easily worked using the conventional tools used for drill stem joint makeup or breakout operations.

Referring now to FIGS. 4 through 7, a first alternate embodiment of a downhole tool in accordance with the present invention is illustrated and generally designated by the numeral 70. The tool 70 is also provided with an elongated generally cylindrical body 72 having a head portion 74 with an internally threaded portion 76 and a tail portion 78 with an externally threaded pin portion 80 extending axially therefrom. The body 72 also includes a reduced diameter portion 82 interposed between the respective head and tail portions 74 and 78 and having formed thereon an integral part 83 of polygonal cross-section and forming a plurality of flats or planar surfaces 84. As indicated particularly in FIG. 5, the specific cross-sectional configuration of the body part 83 is substantially hexagonal in shape and, accordingly, is provided with six bearing flats or locking surfaces 84. Relief surfaces 85 are interposed between the adjacent surfaces 84. It will be appreciated from the description herein that the specific cross-sectional configuration providing the locking surfaces 84 may form geometric shapes other than a hexagon.

The body 72 is also provided with an axially extending central passage 86 whereby the tool 70 may be interposed in a conventional drill stem such as the drill stem 11. The body 72 is also provided with a portion 88 extending from a transverse shoulder 92 on the tail portion 78 toward the reduced diameter portion 82 and provided with external threads 90. The threads 92 may or may not extend along a major portion of the body portion 88 depending on the configuration of mechanism for retaining and securing removable tool sections on the tool 70 described further herein. Moreover, the body portion 88 may be an extension of the body portion 82. The tool 70 includes removable tool sections such as half cylindrical stabilizer sleeve sections 94 and 96, respectively, which are similar in some respects to the tool sections 18 and 20. The tool sections 94, 96 are provided with wear surfaces including helical flutes or ribs 98 and with axially extending opposed tapered arcuate flanges 100 and 102 formed on opposite ends of the tool sections, as shown. One advantage in providing the replaceable tool sections 18, 20, 94 and 96 as sleeve sections with wear ribs resides in the fact that, in many applications of these tools, the sleeve outer surfaces adjacent the ribs are also worn by abrasion of drill chips and circulation fluids with flow rapidly through the annulus between the drill stem and the drillhole.

Figure 5:
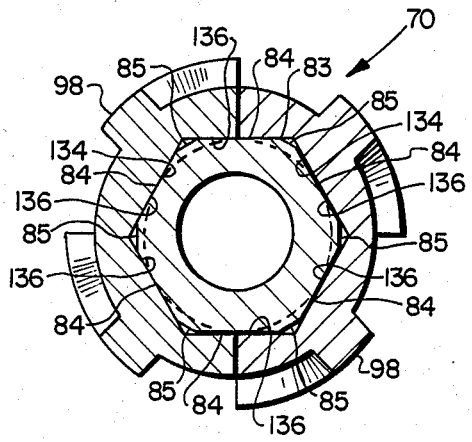
FIG. 5 is a section view taken along the line 5—5 of FIG. 4.
Figure 6:
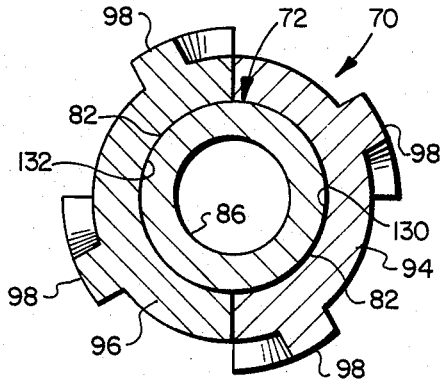
FIG. 6 is a section view taken along the line 6—6 of FIG. 4.

Referring to FIG. 6, the tool sections 94 and 96 are each provided with curved inner surfaces 130 and 132 which are dimensioned to fit close around the cylindrical outer surface of the reduced diameter section 82. The tool sections 94 and 96 are also provided with polygonal shaped internal recesses 134 which are configured to have the same cross-sectional shape, when assembled together, as seen in FIG. 5, as the cross-sectional shape of the part 83. The recesses 134 are defined by intersecting flat surfaces 136 which are configured to form a hexagonal socket when the tool sections 94 and 96 are assembled around the body part 83. In this way, the tool sections 94 and 96 are non-rotatably locked to the body 72 when assembled thereon. Those skilled in the art will appreciate that the specific configuration of the recesses 134 need not conform to the full hexagonal shape of the part 83 as long as cooperating surfaces 136 and 84 of sufficiently generous bearing area are provided which prevent rotation of the tool sections about the central axis 15 of the body 72. However, it is advantageous to provide a full hexagonal socket formed by the surfaces 136 which each engage corresponding surfaces 84 and which are of generous length so that a relatively large bearing area is provided for drivably engaging the tool sections 94 and 96 by the body 72 in operation of the tool 70. This configuration of the cooperating surfaces 136 and 84 is particularly important for use in alternate tool sections shown in FIG. 7 which are of a type subjected to especially severe loading when working in a drillhole.

Figure 7:
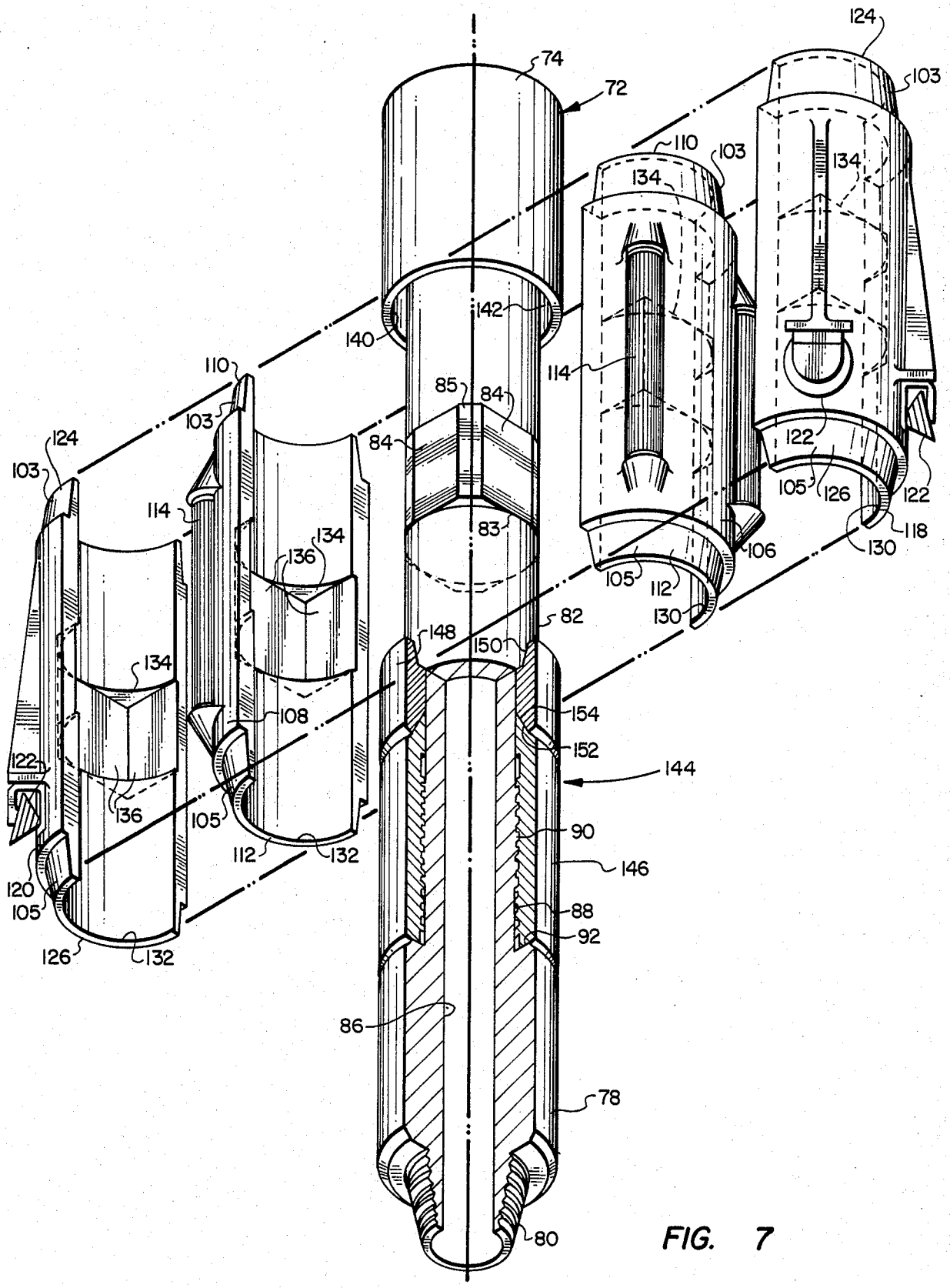
FIG. 7 is a perspective view, partially sectioned and partially exploded, of the embodiment illustrated in FIGS. 4 and 5.

As indicated in FIG. 7, the tool sections 94 and 96 may be interchanged with tool sections for performing other functions using the body 72 and without disconnecting the body from the drill stem. For example, tool sections comprising generally cylindrical half sleeve sections 106 and 108 may be used in conjunction with the body 72 in place of the tool sections 94 and 96. The tool sections 106 and 108 have opposed tapered arcuate flanges 110 and 112 configured substantially the same as the flanges 100 and 102. The tool sections 106 and 108 are provided with tool means comprising elongated cutting surfaces 114 on the outer surfaces of the tool sections for performing reaming operations in a drillhole or on certain structures disposed in the drillhole.

Still further in accordance with the present invention, the tool 70 may be modified to utilize tool sections 118 and 120 which are adapted to be supported on the body 72 in the same manner as the tool sections 94, 96, 106, and 108. The tool sections 118, 120 form a hole enlarger or under-reamer and are provided with cutting members 122 on their outer surfaces. The tool sections 118 and 120 are also provided with axially extending tapered arcuate flanges 124 and 126, respectively, which are operable to support the tool sections 118 and 120 on the body member 72 in a manner to be described herein in conjunction with further description of the tool sections 94 and 96. The tool sections 106, 108, 118 and 120 are also formed with curved inner surfaces 130 and 132, and recesses 134 defined by the flat surfaces 136 so that these alternate tool sections may be mounted on the body portion 82 and drivably engaged by the part 83.

The tool sections 94 and 96 as well as the tool sections 106, 108 and 118, 120 may also be mounted on and removed from the body 72 without breaking the threaded joints between the tool 70 and the drill stem by moving the tool sections substantially radially toward and away from the body 72. In this regard, the head 74 is provided with a circumferential annular recess 140 which is defined in part by an axially tapered wedging surface 142 cooperating with outer tapered surfaces 103 of the respective flanges 100 on the tool sections 94 and 96, for example, and on the corresponding flanges on the tool sections 106, 108, and 118, 120.

Figure 4:
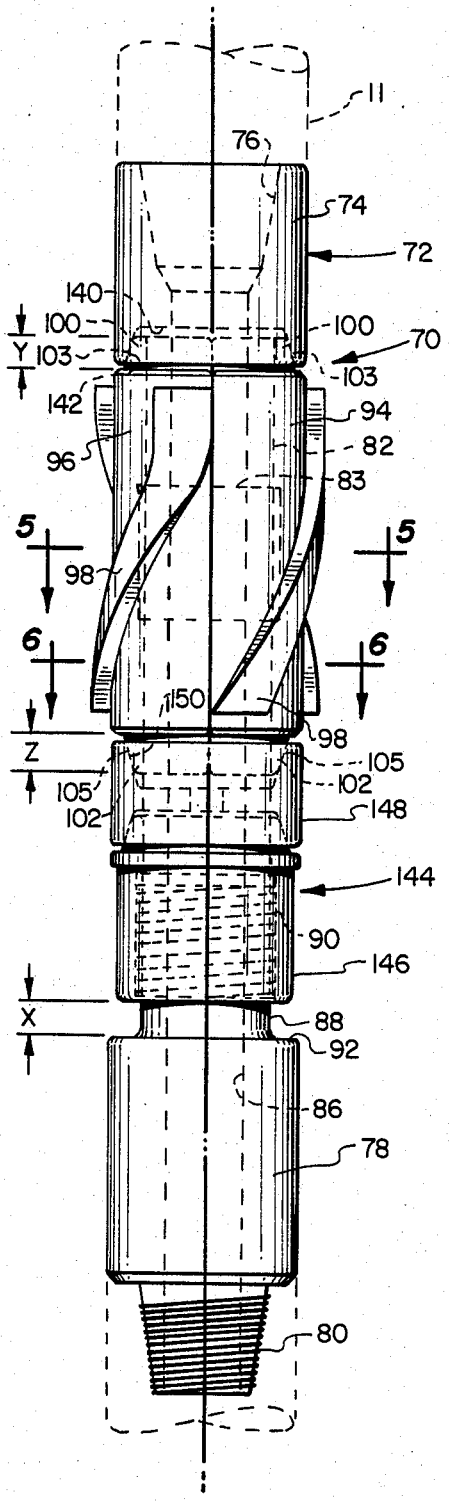
FIG. 4 is a side elevation view of a first alternate embodiment of a downhole tool in accordance with the present invention.

As shown in FIGS. 4 and 7, the tool 70 also includes a mechanism, generally designated by the numeral 144, for releasably securing the tool sections 94, 96, 106, 108 or 118, 120 in assembly with the body 72. The mechanism 144 includes a cylindrical locknut 146 threadedly engaged with the threads 90 on the body portion 88, the locknut 146 is cooperable with a cylindrical collar 148 for axially forcing the collar into engagement with tapered surfaces 105 on the flanges 102. The collar 148 is provided with a tapered counterbore portion 150 which wedgingly engages tapered surfaces 105 on the flanges 102 and corresponding flanges on the tool sections 106, 108, 118 and 120 in a manner similar to the way in which the surface 62 on the collar 50 cooperates with the flanges 36 on the tool sections 18, 20. The collar 148 and the locknut 146 are also provided with cooperating tapered wedging surfaces 152 and 154, respectively. The threadless collar 148 is freely movable axially on the body portion 88 and provides for improved locking characteristics including the cooperating wedge surfaces 152–154 to prevent unwanted loosening of the locknut 146.

The tool 70 is preferably provided with the same dimensional relationship as regards the length of the respective flanges 100 and 102 and the distance between the lower end of the nut 146 and the shoulder 92 as is provided by the X, Y and Z dimensions of the tool 10. In this way, tool sections 94 and 96 may be assembled and disassembled with respect to the body 72 with minimum chance of the tool sections falling off of the body or being lost in some manner. Those skilled in the art will appreciate that the tool sections 106, 108 and 118, 120 are dimensioned to be completely interchangeable with the tool sections 94 and 96 and further detailed discussion regarding the dimensions and proportions of the alternate tool sections is not believed to be necessary to practice the present invention.

The tool 70 has certain advantages over the tool 10 described previously herein. By providing the cooperating drive surfaces 84 and 136 between the body member 72 and the tool sections 94 and 96, the groove 140 for receiving the flanges 100 and the counterbore 150 for receiving the flanges 102 may be made circumferential. Moreover, the collar 148 does not require the formation of axial keyways to accommodate keys formed on the body member nor is it important the collar be prevented from rotating while at least being initially tightened against the flanges of the tool sections 94 and 96. When it is desired to mount a pair of the tool sections 94, 96 on the body 72 the locknut 146 is threaded axially downwardly, viewing FIGS. 4 and 7, by rotating the locknut until it engages the shoulder 92 and the collar 148 is also moved downwardly to provide sufficient clearance to insert first the flanges 100 of the tool sections 94 and 96 into the groove 140 and then radially close the tool sections toward each other so that the collar 148 may be moved upwardly into engagement with the flanges 102. The locknut 146 is then rotated to move it axially upward into engagement with the collar 148. The locknut 146 may then be conveniently tightened by tongs or other wrench means normally used on a drill rig for tightening or breaking loose joints between drill stem sections. The tool sections 94 and 96 are thus secured on the body 72 and may be easily replaced without breaking either joint connecting the tool 70 into the drill stem by threading the nut 146 downwardly towards the shoulder 92 and removing the tool sections in substantially the reverse order to that described above.

The locknut 146 and the collar 148 are, of course, permanently retained on the body 72 and may be initially mounted on the body using various techniques. For example, the tail portion 78 may be formed as a separate sleeve portion having an inner bore diameter equal to or slightly less than the root diameter of the threads 90 and force fitted, for example, over a lower cylindrical portion of the body 72. The tail portion 78 may also be suitably welded or otherwise secured to the main portion of the body 72 after assembly of the locknut and collar onto the body section 88. In this way, the body 72, including the opposed portions forming the box and pin threads 76 and 80, may be machined from bar stock or suitable forging stock as a unitary piece having the requisite strength to be interposed in a drill stem. Alternatively, the locknut 146 and the collar 148 may be formed as split cylindrical half sleeve sections welded together upon assembly to permanently secure then on the body portion 88. Of course, if desired, the body 72 may be formed in separate sections such as an upper and lower portion split along part of the reduced diameter section 82 and suitably welded to form a unitary assembly, after assembly of the locknut 146 and the collar 148 onto the body portion 188. It should also be noted that the "hand" of the threads 90 and the cooperating threads on the locknut 146 should be such that the normal direction of rotation of the tool 70 will tend to tighten the locknut 146 against the collar 148 to prevent loosening of the locknut while the tool 70 is working. In this regard, if the threads 76 and 80 are right hand then the threads 90 and the cooperating threads on the locknut 146 should also be right hand.

Figure 8:
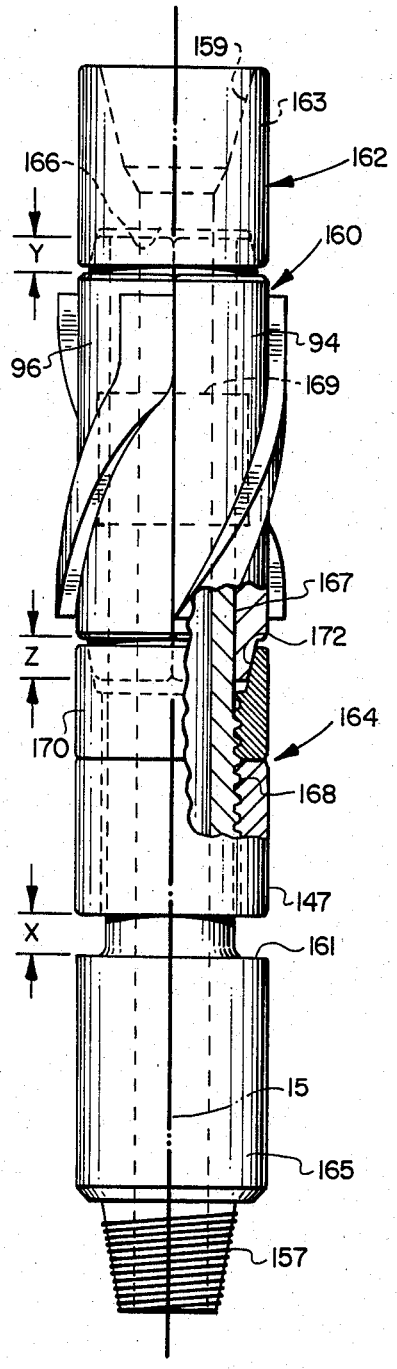
FIG. 8 is a side elevation view of a second alternate embodiment of a downhole tool.

Referring now to FIG. 8, a second alternate embodiment of a downhole tool in accordance with the present invention is illustrated and generally designated by the numeral 160. The tool 160 is substantially similar to the tool 70 and includes an elongated body 162 adapted to receive the tool sections 94 and 96 for retention thereon by a mechanism 164. The body 162 includes respective head and tail portions 163 and 165 and a reduced diameter portion 167 substantially identical to the body portion 82 and including a part 169 similar to the part 83. The head and tail portions respectively include internal threads 159 and external threads 157. The body 162 includes external threads 168 extending along the body portion 167. The threads 168 are cooperable with the corresponding internal threads on the locknut 147 and with a modified collar 170 which is also provided with internal threads to function as a locknut. The collar 170 is provided with a tapered counterbore or recess 172 for engagement with the flanges 102 on the respective tool sections 94, 96, for example, to retain the tool sections in assembly on the body 162 in generally the same manner as they are retained on the body 72.

However, by providing the collar 170 with internal threads and extending the threads 168 axially along the body portion 167 the collar 170 and the locknut 147 may be tightened together to prevent loosening of the locknut 147 when the tool sections are secured between the collar and the head portion 163. Moreover, by providing the threaded collar 170 as a threaded member the tool sections 94, 96 may be easily retained on the body 162 by first hand tightening the collar to retain the tool sections between the collar and the head portion 163 with the flanges 100 disposed in an annular recess 166 and the flanges 102 disposed in engagement with the tapered wall of the counterbore 172. The locknut 147 may then be tightened while holding the collar 170 to provide a double locknut configuration for enhanced security against loosening of the securing mechanism. The distance X between the locknut 147 and a shoulder 161 is less than the flange length Y but greater than the flange length Z.

Figure 9:
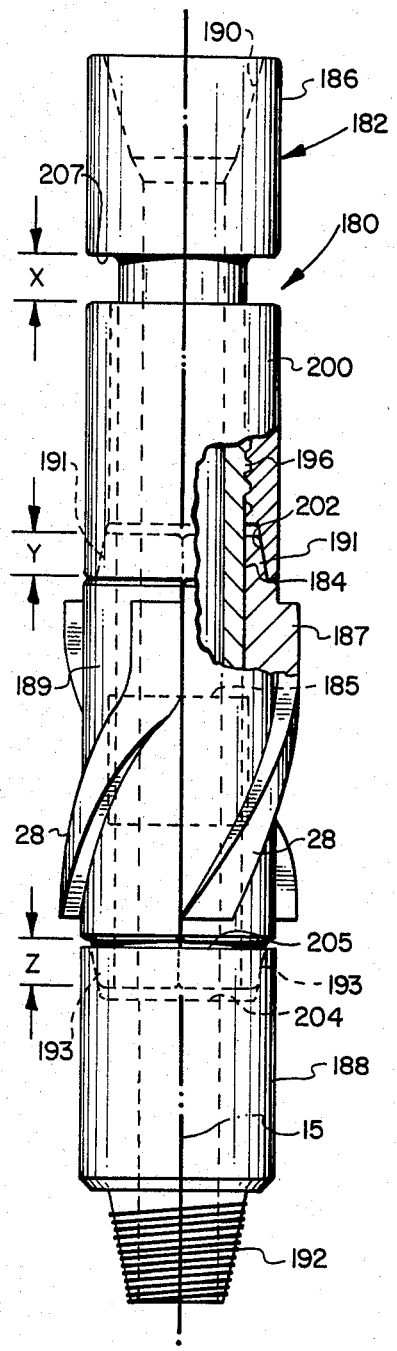
FIG. 9 is a side elevation view of a third alternate embodiment of a downhole tool.

A third alternate embodiment of a downhole tool in accordance with the present invention is illustrated in FIG. 9 and generally designated by the numeral 180. The tool 180 includes an elongated body member 182 having an intermediate reduced diameter portion 184, a head portion 186 and a tail portion 188. The head portion 186 is provided internal threads 190 and the tail portion 188 includes with an external threaded pin portion 192. The body portion 184 is also provided with a part 185 identical to the part 83 and having surfaces engageable with corresponding surfaces on the inner sides of modified tool sleeve sections 187 and 189, for example. The tool sections 187 and 189 are similar to the tool sections 94 and 96 except for the lengths of upper and lower arcuate tapered flanges 191 and 193, respectively. The body 182 is also provided with an intermediate threaded portion 196 between the body portion 184 and the head portion 186. The threaded portion 196 engageable with a cylindrical locknut 200. The locknut 200 is provided with a recess formed by a tapered counterbore 202 configured to engage and retain the flanges 191 of the respective tool sections 187 and 189 in the same manner as the collar 170 retains the lower flanges 102 in the embodiment of FIG. 7. The body 182 is also modified to provide an annular tapered recess 204 formed in the upper end face 205 of the tail portion 188 and facing the locknut 200.

In the assembled condition of the tool 180 as shown in FIG. 9, the maximum clearance X between a shoulder 207 on the head portion 186 and the end of the locknut 200 facing the shoulder is greater than the axial length Z of the flanges 193 but less than the axial length Y of the flanges 191. Accordingly, the nut 200 may be unthreaded from the retaining position with respect to the tool sections 187 and 189 by moving the nut toward the shoulder 207 without having the sleeve sections 187, 189 fall out of engagement with the nut. One advantage of the tool 180 is that the tool sections 187 and 189, for example, may be inserted with their respective flanges extending into the tapered recesses 202 and 204 and retained relatively easily on the tool 180 while the nut 200 is being tightened down against the flanges 191. Moreover, the tool 180 eliminates the collar 170 or the similar collars used in conjunction with the tools 10 and 70. Although the locknut 200 rotates relative to the flanges 191 as tapered surfaces forming the recess 202 engage the flanges, these surfaces may be suitably lubricated at assembly to reduce galling.

Figure 10:
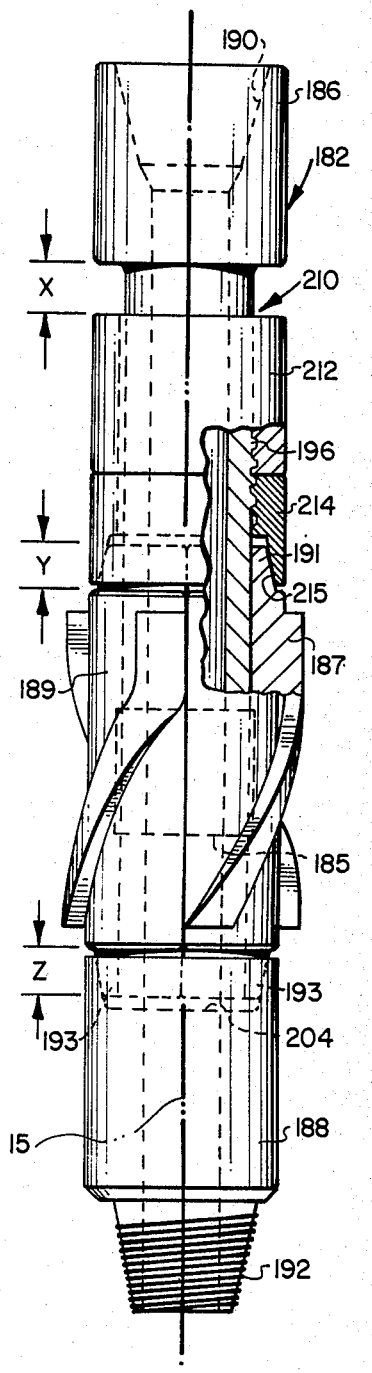
FIG. 10 is a side elevation view of a fourth alternate embodiment of a downhole tool in accordance with the present invention.

A fourth embodiment of a downhole tool 210 is illustrated in FIG. 10. The tool 210 includes the body member 182 and a securing mechanism including a modified locknut arrangement comprising a locknut 212 and a threaded collar 214 similar to the respective locknut 147 and collar 170 except for the provision of threads of the opposite hand for cooperation with the threads 196. The collar 214 includes a tapered counterbore 215 for receiving the tapered flanges 191. Accordingly, the tool 210 is adapted to releasably retain removable tool sections 187 and 189 by a double locknut arrangement similar to that provided for the tool 160 and with the advantage that the tool sections 187 and 189 may be inserted in the recesses 204 and 215 and easily held in place while the locknuts are being threaded into engagement with the tool sections and tightened to retain the tool sections in assembly with the body 182. As with the arrangement for the tool 70, the tools 160, 180 and 210 are provided with means for securing the removable tool sections which is axially movable on the body members and at all times is retained on the body members to eliminate any chance of losing a component of the securing mechanism.

Although several embodiments of a downhole tool have been described herein in detail those skilled in the art will recognize that various substitutions and modifications may be made to the embodiments described without departing from the scope and spirit of the invention as recited in the appended claims.

What I claim is:

1. A downhole tool for connection to a drill stem as a section of said drill stem, said tool comprising:

a body including means on at least one end of said body for connecting said body to said drill stem;

a plurality of tool sections mountable on said body and removable from said body by moving said tool sections radially with respect to a central axis of said body and without disconnecting said body from said drill stem;

retaining means including means threadedly engaging said body and said tool sections and axially movable by rotation on the threads on said body between a locked position where said tool sections are secured on said body and an unlocked position where the tool sections may be axially removed from the body, and stop means positioned on the body for limiting the axial movement of the retaining means at the unlocked position to prevent loss of said retaining means from said tool upon intentional movement to the unlocked position while removing the tool sections or accidental loosening while operating in a wellbore.

2. The tool set forth in claim 1 wherein:

said tool sections comprises at least two partial cylindrical sleeve sections mounted on said body to overlie at least a portion of said body intermediate the ends of said body.

3. The tool set forth in claim 2 wherein:

said sleeve sections and said body include respective portions cooperable to prevent rotation of said sleeve sections on said body.

4. The tool set forth in claim 3 wherein:

said sleeve sections include axially projecting end portions insertable in recess means formed on said body, said end portions being engageable with abutment means on said body to prevent rotation of said sleeve sections relative to said body.

5. The tool set forth in claim 3 wherein:

said sleeve sections each include surfaces formed on an inner side of said sleeve sections engageable with cooperable surfaces formed on said body to prevent rotation of said sleeve sections relative to said body.

6. The tool set forth in claim 2 wherein:

said sleeve sections each include axially projecting portions on opposite ends of said sleeve sections, respectively, said one of said portions being insertable in cooperating recess means on said body for supporting said sleeve sections on said body, said means for securing said sleeve means being engageable with the other of said portions on said sleeve sections, respectively, for releasably retaining said sleeve sections on said body.

7. The tool set forth in claim 6 wherein:

said means for securing said sleeve sections includes a nut threadedly engaged with a cooperating threaded portion on said body.

8. The tool set forth in claim 7 wherein:

said means for securing said sleeve sections includes a collar disposed on said body between said nut and said sleeve sections and including recess means for receiving the other of said portions of said sleeve sections, respectively.

9. The tool set forth in claim 8 wherein:

said collar is threaded and is engageable with cooperating threads on said body for axially moving said collar into and out of engagement with the other of said portions on said sleeve sections.

10. The tool set forth in claim 2 wherein:

each of said sleeve sections includes first and second axially extending opposed flanges;

said body includes recess means formed in a head portion which are sized for receiving one of said flanges of said respective sleeve sections;

said tool includes axially movable means mounted on said body and positioned to selectively move into and out of engagement with the other of said flanges of said sleeve sections, said axially movable means including locknut means threadedly mounted on said body for moving said axially movable means into engagement with said other flanges upon tightening said locknut means and for permitting disengagement of said axially movable means from said other flanges upon loosening said locknut means.

11. The tool set forth in claim 10 wherein:

said other flanges are sized so as to not fit within said recess means to thereby prevent upside down mounting of said sleeve sections on said body.

12. The tool set forth in claim 10 wherein:

the maximum distance of travel of said locknut means is X, the length of one of said flanges is Y, which is greater than X, and the length of the other of said flanges is Z, which is less than X.

13. The tool set forth in claim 10 wherein:

said flanges include tapered surfaces formed thereon and said recess means include surface means engageable with said tapered surfaces for wedging engagement and for locating said sleeve sections substantially coaxially with respect to said axis of said body.

14. The tool set forth in claim 2 wherein:

said sleeve sections include means formed on the outer sides of said sleeve sections forming a drill stem stabilizer when mounted on said body.

15. The tool set forth in claim 2 wherein:

said sleeve sections include cutting elements disposed on the outer sides of said sleeve sections for performing cutting operations in a drillhole when said sleeve sections are mounted on said body.

16. A downhole tool for connection to a drill stem as a section of said drill stem, said tool comprising:

an elongated body having an integral cylindrical section of uniform minimum wall thickness approximating at least the cross-sectional area of the standard drill pipe in which the tool is to be connected including the standard enlarged box and pin portions at opposite ends thereof sized to receive tongs and operable for connecting said body to said drill stem;

at least two tool sections including tool means disposed on the outer sides of said tool sections, respectively, said tool sections being mountable on and removable from a central portion of said body without disconnecting said body from said drill stem;

said tool sections comprising partial cylindrical sleeve sections cooperable to substantially enclose a portion of said body intermediate said ends;

means on said tool sections and said body engageable to prevent rotation of said tool sections with respect to said body;

means disposed around said body including a sleeve threaded on the body for axial movement thereon between a locked position for engaging said tool sections and securing said tool sections on said body and an unlocked position where the tool sections may be removed from the body; and one of the enlarged box or pin portions limiting the axial movement of the means disposed around said body to the unlocked position to prevent loss of said retaining means from said tool upon intentional movement to the unlocked position while removing the tool sections or accidental loosening while operating in a wellbore.

17. The tool set forth in claim 16 wherein:

the central portion of the body is cylindrical, and said sleeve sections include axially projecting arcuate flanges on opposite ends of said sleeve sections, respectively, said flanges being insertable in cooperating recesses formed in an enlarged section of said body and on said means for securing said sleeve sections on said body, respectively.

18. The tool set forth in claim 16 wherein:

said means on said sleeve sections and said body to prevent rotation include a polygonal cross-section portion of said body having a minimum diameter at least as large as the cylindrical section including surface means engageable with cooperating surface means on the inner sides of said sleeve sections, respectively.

19. The tool set forth in claim 16 wherein:

said means on said tool sections and said body to prevent rotation includes abutment means on said body engageable with axially projecting surfaces on opposite ends of said sleeve sections, respectively.

20. The tool set forth in claim 16 wherein:

said means for securing said tool sections on said body includes a nut sleeved around said body and threadedly engaged with cooperating threads on said body for axial movement between respective positions for securing said tool sections on and releasing said tool sections from said body.

21. The tool set forth in claim 20 wherein:

said means for securing said tool sections includes a cylindrical collar disposed on said body between said nut and said tool sections.

22. A downhole tool for connection to a drill stem as a section of said drill stem, said tool comprising:

an elongated generally cylindrical body including opposed, enlarged, upper and lower threaded end portions for connection of said body as a section of a drill stem, a reduced diameter portion of said body intermediate said end portions including an externally threaded portion intermediate said end portions;

a nut threaded on the threaded portion for axial movement on said body between a tightened position and a released position, the nut being retained on the body at the released position by one of the enlarged threaded end portions;

a pair of opposed semicircular cylindrical sleeve sections including tool means formed on an outer surface of said sleeve sections, respectively, each of said sleeve sections including means on opposite ends of said sleeve sections, respectively, engageable with means on said body for supporting said sleeve sections on said body around said reduced diameter portion to form a substantially cylindrical tool sleeve on said body;

cooperating surface means on said body projecting from the reduced diameter portion and on recesses formed in the interior surfaces of the sections to prevent rotation of said sleeve sections relative to said body when said sleeve sections are mounted on said body;

said sleeve sections being mountable on and removable from said body without disconnecting said body from said drill stem and said sleeve sections being secured on said body and releasable from said body by axially moving said nut between tightened and released positions on said body.

23. The tool set forth in claim 22 wherein:

said nut includes recess means formed on one end thereof for engaging said retaining means on one end of said sleeve sections, respectively.

24. The tool set forth in claim 22 including:

a cylindrical collar disposed between said nut and said retaining means on one end of said sleeve sections and including recess means for engaging said retaining means on said one end of said sleeve sections.

25. The tool set forth in claim 24 wherein:

said collar includes a threaded portion engageable with said threaded portion on said body intermediate said end portions and operable to be axially moved into and out of engagement with said retaining means on said one end of said sleeve sections.

26. The tool set forth in claim 22 wherein:

said lower end portion of said body includes recess means for receiving retaining means on one end of said sleeve sections and said nut is disposed between said sleeve sections and said upper end portion of said body.

27. The tool set forth in claim 22 wherein:

said cooperating surface means on said sleeve sections and said body include surfaces on said reduced diameter portion of said body engageable with surfaces formed on the inner sides of said sleeve sections, respectively.

28. The tool set forth in claim 22 wherein:

said cooperating surface means on said sleeve sections and said body comprise abutments formed on said body and engageable with surfaces on said retaining means on said sleeve sections, respectively.

29. A downhole tool for connection to a drill stem as a section of said drill stem, said tool comprising:

an elongated generally cylindrical body including enlarged upper and lower end portions each including thread means for connection of said body as a section of a drill stem;

at least two partial cylindrical tool sleeve sections including, respectively, axially projecting tapered flanges formed on opposite ends of said sleeve sections and collectively forming a complete segmented sleeve around the cylindrical body;

recess means formed on one of said end portions of said body defining a complete annular groove for receiving said flanges on one end of said sleeve sections;

recess means defining a complete annular groove formed on a cylindrical member disposed around the body and axially movable on said body and engageable with said flanges on the other end of said sleeve sections; and said recess means including arcuate tapered surfaces within the annular grooves engageable with corresponding arcuate tapered surfaces on said flanges for centering said sleeve sections on said body and retaining said sleeve sections substantially coaxially on said body in response to axial movement of said cylindrical member into forcible engagement with said sleeve sections.

30. A replaceable tool section for a downhole tool having an elongated tubular body with a generally cylindrical center section separating larger end portions operable for connecting the body into said drill stem and a polygonal drive section in which the number of sides is an even integer formed on the cylindrical center section and having apexes larger than diameter of the center section, said replaceable tool sections comprising:

a semicircular generally cylindrical body having operative tool means on the exterior thereof, and an interior surface including a plurality of flats of a polygonal surface adapted to mate with the drive section equal to half the number of flats on the drive, the plane of the open side of the body extending between two opposite apexes of the polygon, a pair of semicircular surfaces on each side of the flats for mating with the cylindrical center section, and tapered flange means on each end of the body adapted to be engaged by circumferential retaining means carried by the body.

31. A downhole tool for interconnection in a drill stem as a section of said drill stem, said tool comprising:

a tubular body including means at each end of said body for connecting said body into said drill stem to transmit the longitudinal and torque loads normally associated with the drill stem and to permit fluid flow through said body;

a plurality of tool sections positionable on said body in operating positions and removable from said body for replacement by moving said tool sections generally radially with respect to the longitudinal axis of said body while said body is interconnected in said drill stem and said drill stem is suspended in vertical position extending through a drilling rig floor;

coupling means disposed around said body and portions of said tool sections having at least one portion axially movable between a locked position for holding the tool sections in the operative positions and an unlocked position where the tool sections are held in position by the coupling means adjacent said body but are manually removable from the tool while the drill stem is vertically oriented and the coupling means is in the unlocked position and while the coupling means is being moved between the unlocked position and the locked position.

32. The downhole tool of claim 31 wherein:

said tool sections comprise at least two partial cylindrical sections each adapted to encircle at least a portion of the central section of the body and having an arcuate, circumferentially extending flange at each end; and said coupling means includes circumferentially extending flanges forming facing, circumferentially extending annular grooves disposed at each end of the tool sections for receiving the flanges of tool sections and preventing radial movement of the tool sections away from the body when the flanges are received in the grooves, at least one of the annular grooves being formed by a sleeve movable axially of said body between said locked position in which the flanges are received in and retained by both of the grooves and said unlocked position in which the grooves are spaced apart sufficiently to allow the tool sections to be removed from the body.

33. The downhole tool of claim 32 wherein:

the tool sections will rest in the lower annular groove when said coupling means is in the unlocked position and while said grooves are being moved between the unlocked positions and locked positions without material assistance from a worker.

34. The downhole tool of claim 33 wherein:

said sleeve means is axially movable only to a limited position to provide a maximum axial spacing between the two circumferentially extending flange means forming the groove which is less than the distance between the ends of the flanges on opposite ends of the tool sections so that the tool sections must first be moved axially upwardly to disengage the lower flange of the tool section from the lower groove, and then lowered to withdraw the upper flange of the tool section from the upper groove.

35. A downhole tool for connection to a drill stem as a section of the drill stem, said tool comprising:

an elongated tubular body having a generally cylindrical center section separating larger end portions operable for connecting the body into said drill stem;

a drive section formed on the center section having a polygonal shaped cross-section in which the number of sides in an even integer;

a pair of semicircular tool sections disposed around the drive section and having matching interior drive surfaces, the tool sections being divided along opposite apexes of the polygonal drive section; and means for engaging the opposite ends of the tool sections to hold the tool sections around the drive section.

36. The downhole tool of claim 35 wherein the polygonal shaped cross section has six equal sides.

37. The downhole tool set forth in claim 35 wherein opposite flats of the polygonal drive section are spaced apart a distance approximately equal to the diameter of the center section.

38. The downhole tool set forth in claim 35 wherein the interior drive surfaces of the semicircular tool sections are axially longer than the drive section to permit axial movement of the tool sections relative to the drive section while held against the drive section; and one of the ends of the tool sections are retained in an annular groove formed in one of the enlarged end portions and the other of the ends of the tool section are retained in a nut threaded on the cylindrical center section.

* * * * *